US010124347B2

(12) United States Patent
Meineke, Jr. et al.

(10) Patent No.: US 10,124,347 B2
(45) Date of Patent: Nov. 13, 2018

(54) ADJUSTABLE DISCHARGER RAM SPACING

(71) Applicant: The Western States Machine Company, Fairfield, OH (US)

(72) Inventors: Donald W. Meineke, Jr., Loveland, OH (US); William F. Temple, Brookville, IN (US); Gregory L. Allgaier, Jr., Monroe, OH (US)

(73) Assignee: The Western States Machine Company, Hamilton, OH (US)

( * ) Notice: Subject to any disclaimer, the term of this patent is extended or adjusted under 35 U.S.C. 154(b) by 283 days.

(21) Appl. No.: 14/927,726

(22) Filed: Oct. 30, 2015

(65) Prior Publication Data

US 2016/0121343 A1 May 5, 2016

Related U.S. Application Data

(60) Provisional application No. 62/073,484, filed on Oct. 31, 2014.

(51) Int. Cl.
*B04B 11/04* (2006.01)
*B04B 11/08* (2006.01)

(52) U.S. Cl.
CPC ..... *B04B 11/04* (2013.01); *B04B 11/08* (2013.01)

(58) Field of Classification Search
CPC ..... B04B 11/04; B04B 11/08
USPC ..... 210/91, 138, 375, 376; 494/42, 55; 15/93.1
See application file for complete search history.

(56) References Cited

U.S. PATENT DOCUMENTS 2,261,914 A * 11/1941 Hertrich ..... B04B 13/00 210/139
2,628,719 A * 2/1953 Hertrich ..... B04B 11/08 210/375
2,708,035 A 5/1955 Hertrich
2,776,753 A * 1/1957 Hertrich ..... B04B 11/08 210/363
3,339,733 A * 9/1967 Grieselhuber ..... B04B 11/08 210/138

FOREIGN PATENT DOCUMENTS

CN 202010579 U * 10/2011 ..... B04B 11/08

* cited by examiner

*Primary Examiner* — Walter D. Griffin
*Assistant Examiner* — Shuyi S. Liu
(74) *Attorney, Agent, or Firm* — Dinsmore & Shohl LLP

(57) ABSTRACT

A centrifuge discharger including a discharger subassembly having multiple wear plates, each wear plate having a receptacle of lateral dimensions set by the internal surfaces of the multiple wear plates The centrifuge also has multiple backing plates laterally positioned around the external surfaces of the wear plates, and at least one spacing mechanism passing through part if the discharger subassembly near the external surface of the multiple wear plate. The discharger includes a discharger shoe assembly joined to the discharger subassembly by the discharger ram, the discharger ram being able to position the discharger shoe assembly.

20 Claims, 6 Drawing Sheets

ADJUSTABLE DISCHARGER RAM SPACING

CROSS-REFERENCE TO RELATED APPLICATIONS

This application claims the benefit of U.S. Provisional Application Ser. No. 62/073,484, filed Oct. 31, 2014, which is incorporated herein by reference in its entirety.

BACKGROUND

Dischargers are commonly used to remove sugar or other solid materials from a centrifuge basket wall following the centrifuge operation. A discharger shoe moves vertically down the basket wall to remove the material and is pulled away from the basket wall when not in use. The solids are then discharged via a solids discharge port at the bottom of the centrifuge. Two compressed air operated cylinders usually provide the drive for the vertical and horizontal movements of the discharger. More specifically, as the discharger ram drives the discharger shoe along the basket wall, the ram travels through the discharger subassembly as it actuates. The subassembly retains the ram, providing the structure required for precise movements and long term operation.

For proper operation, excessive play should not be present in the discharger ram, although a small amount of play is usually necessary. Herein, play is defined as the movement of the discharger ram that is present due to a spacing or gap present between the discharger and the interior of the receptacle, between the discharger and the interior surface of the wear plates, or both. In order to maintain an amount of play that is not excessive, the reception location in the discharger subassembly for the discharger ram may include a means to adjust the amount of play. One conventional method of maintaining the correct amount of play is utilizing shims between the discharger ran and the reception location. If the free play in the ram is excessive, the shims are removed from the discharger subassembly, and replacing them with smaller shims or removing the shims entirely to obtain the desired amount of play. If it is not possible to tighten the ram sufficiently by removing shims, wear plates must be replaced. The cylinder and ram support bracket may also need to be replaced if the discharger was operated for a prolonged period with excessive free play in the ram. This method of adjusting the amount of play requires measurements, several wrench points, the replacement of shim material, and disassembly.

Accordingly, there is a continual need for improved centrifuge systems, and components therewith, which decreases the need for frequent disassembly and shim replacement.

SUMMARY

In one embodiment, a discharger includes a discharger subassembly including multiple wear plates, each wear plate has an internal surface and an external surface, a receptacle that has lateral dimensions set by the internal surfaces of the multiple wear plates, multiple backing plates laterally positioned around the external surfaces of the multiple wear plates, and at least one spacing mechanism passing through part if the discharger subassembly near the external surface of the multiple wear plates, the discharger also includes a discharger ram to be placed into a receiving area of the discharger subassembly, so on insertion, the wear plates are situated between the discharge ram and the backing plates, and the discharger also includes a discharger shoe assembly joined to the discharger subassembly by the discharger ram, the discharger ram being able to position the discharger shoe assembly.

In another embodiment, a centrifuge includes a discharger located on an upper base plate of the centrifuge, where the discharger includes a discharger subassembly including multiple wear plates, each wear plate has an internal surface and an external surface, a receptacle that has lateral dimensions set by the internal surfaces of the multiple wear plates, multiple backing plates laterally positioned around the external surfaces of the multiple wear plates, and at least one spacing mechanism passing through part if the discharger subassembly near the external surface of the multiple wear plates, the discharger also includes a discharger ram to be placed into a receiving area of the discharger subassembly, so on insertion, the wear plates are situated between the discharge ram and the backing plates, and the discharger also includes a discharger shoe assembly joined to the discharger subassembly by the discharger ram, the discharger ram being able to position the discharger shoe assembly.

Features and benefits of the various embodiments of the present invention will become apparent from the following description, which includes figures and examples of specific embodiments intended to give a broad representation of the invention. Various modifications will be apparent to those skilled in the art from this description and from practice of the invention. The scope is not intended to be limited to the particular forms disclosed and the invention covers all modifications, equivalents and alternatives falling within the spirit and scope of the invention as defined by the claims.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings. In the drawings, like numerals represent like elements throughout the several views.

DETAILED DESCRIPTION

Figure 1:
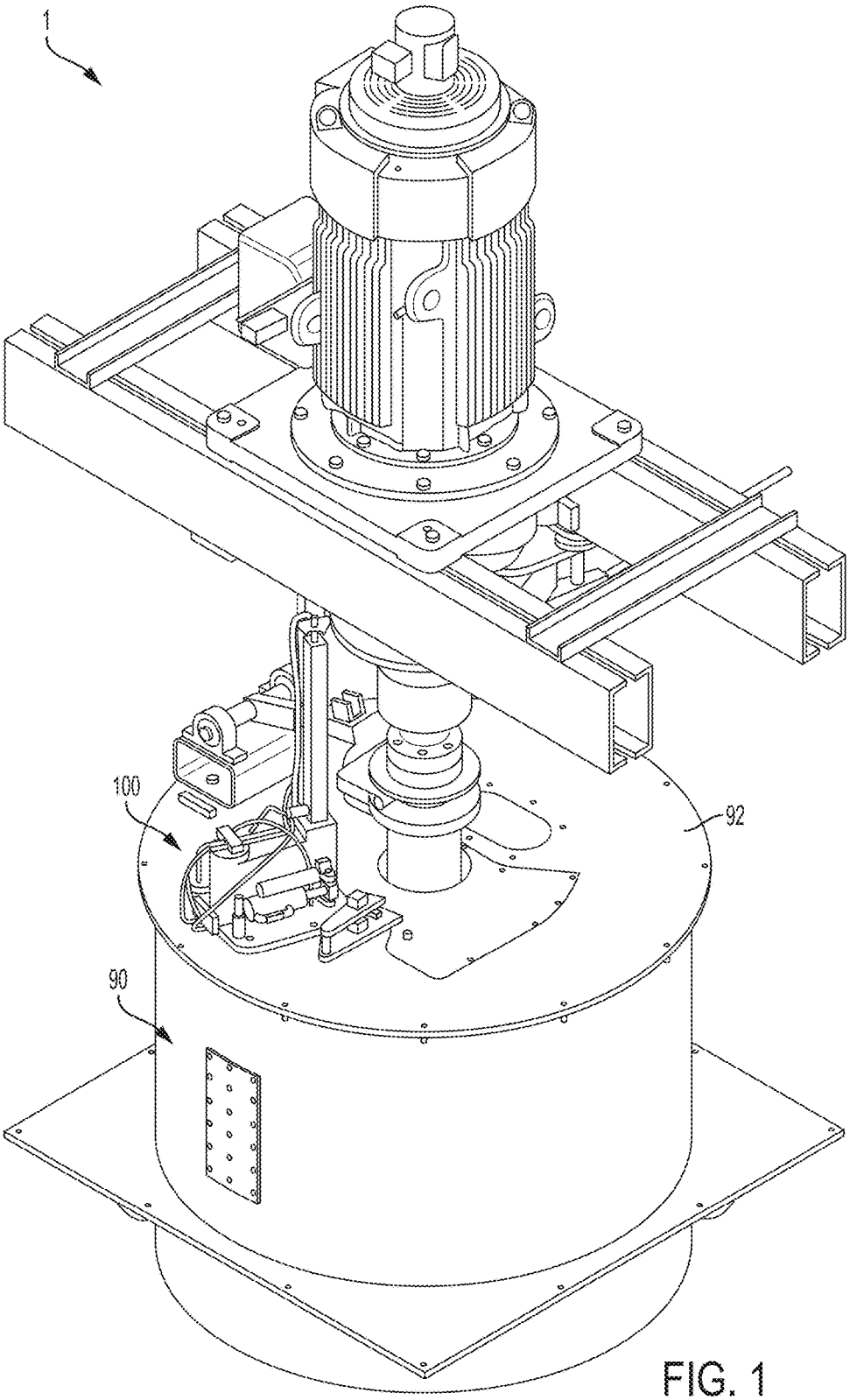
FIG. 1 depicts an isometric view of a centrifuge assembly according to one or more embodiments shown and described herein.
Figure 2:
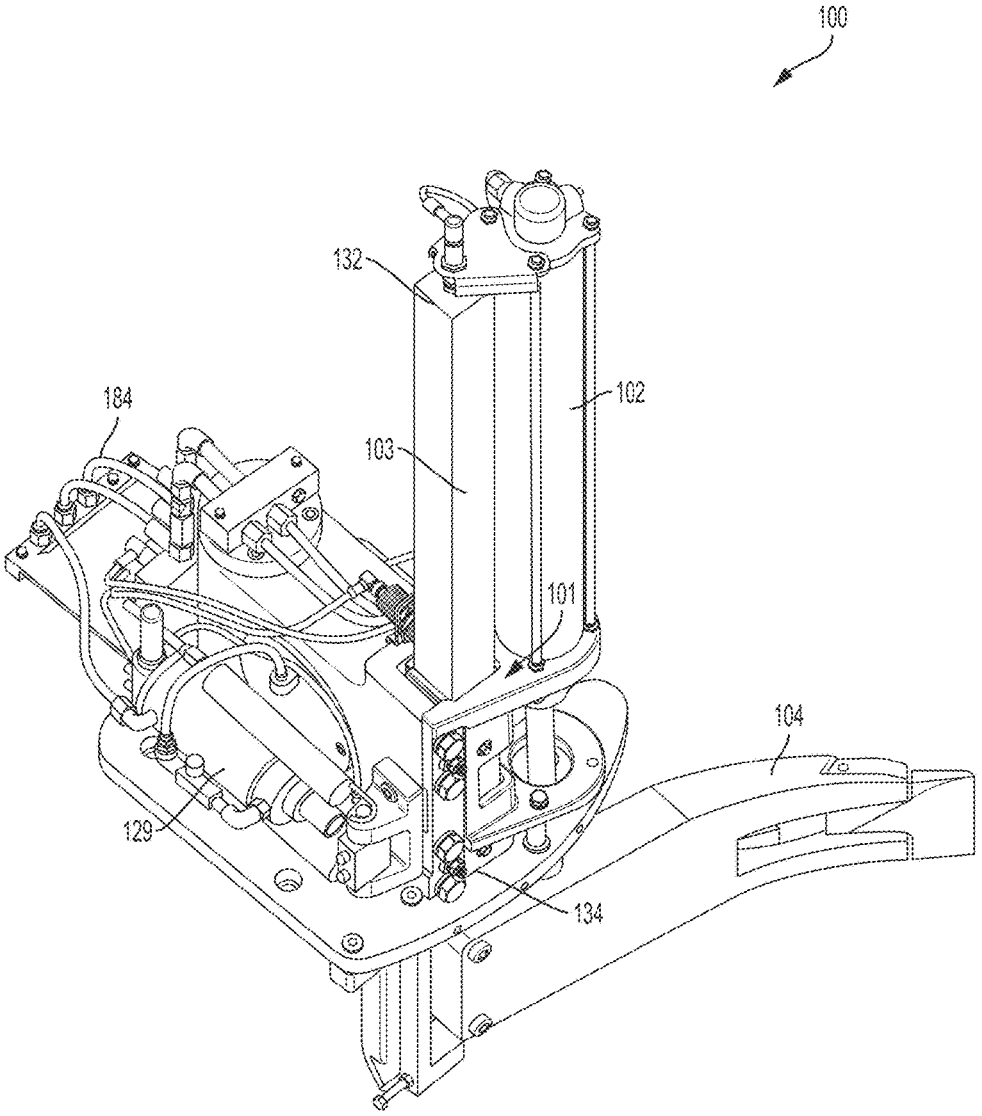
FIG. 2 depicts an isometric view of a discharger according to one or more embodiments shown and described herein.
Figure 3:
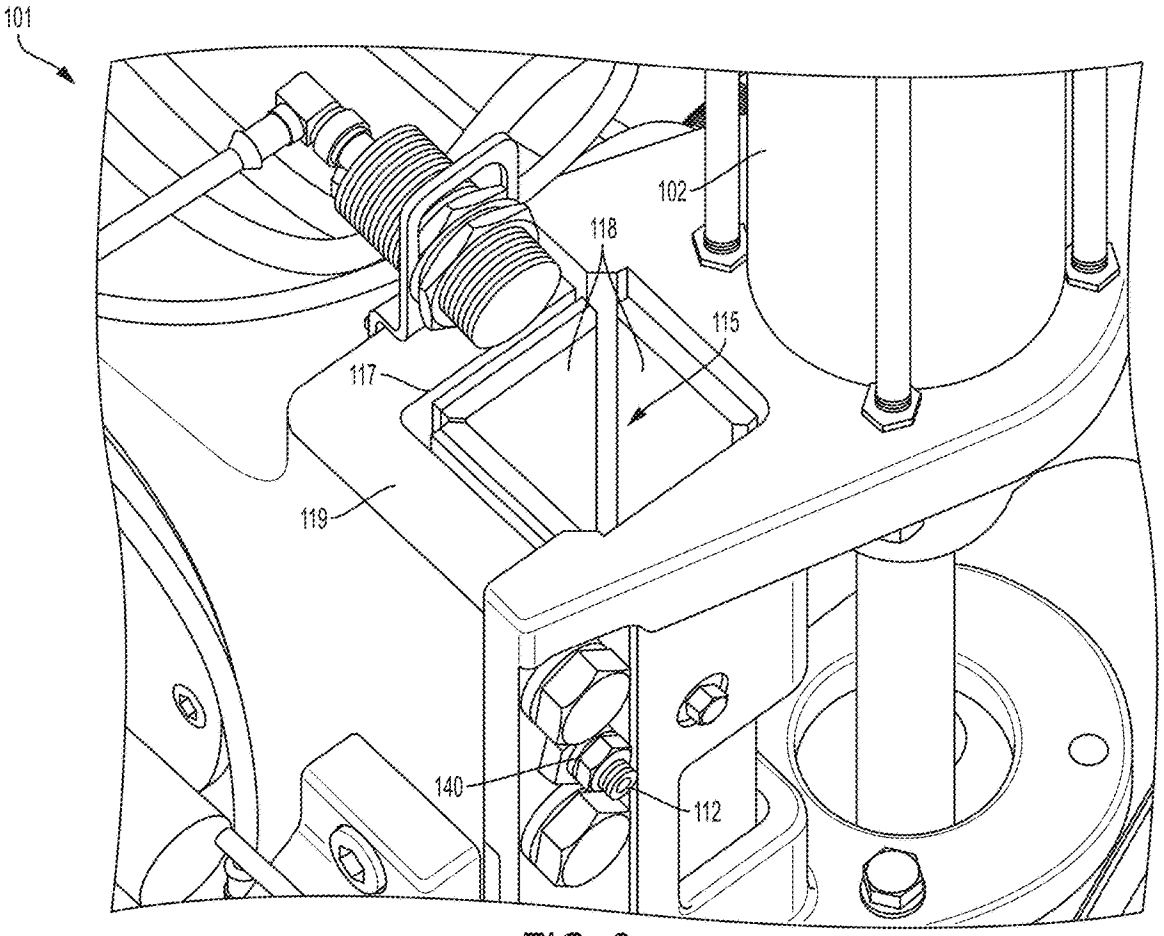
FIG. 3 depicts an isometric view of a discharger with the discharger ram removed according to one or more embodiments shown and described herein.

Referring to FIGS. 1-3, the discharger 100 may comprise a discharger subassembly 101. The discharger subassembly 101 may comprise a number of wear plates 118, where each wear plate 118 has an internal surface and an external surface. The discharger subassembly 101 is also contemplated to include a receptacle 115 having lateral dimensions defined by the internal surfaces of the plurality of wear plates 118, multiple backing plates 119 laterally disposed around the external surface of the wear plates 118, and spacing mechanisms which extend through a part of the discharger subassembly 101 proximate the external surface of the wear plates 118. As used herein, "spacing mechanism" means a component used to move wear plates 118 relative to the backing plate 119 or relative to the discharger ram 103. For example, the spacing mechanism may comprise cam adjustment rods 112 (See FIG. 4B). An embodiment of the discharger 100 may also include a discharger ram 103 that is insertable into the receptacle 115 of the discharger subassembly 101. Upon insertion, the wear plates 118 are between the discharger ram 103 and the backing plates 119. A discharger shoe assembly 104 may be connected to the discharger subassembly 101 by the discharger ram 103, and the discharger ram 103 is operable to position the discharger shoe assembly 104. The discharger shoe assembly 104 may also include a drive mechanism for driving the discharger shoe. As used herein, "drive mechanism" means a component used to move the discharger subassembly 101 or the discharger shoe assembly 104. For example, the drive mechanism may comprise an air cylinder, such as the driving air cylinder 102 or the actuating air cylinder 129. Additionally, the actuation of the spacing mechanisms moves the wear plates 118. The actuation will therefore adjust either a spacing between the wear plates 118 and backing plates 119, spacing between the wear plates 118 and the discharger ram 103, or both. It is also contemplated that the discharger 100 may be disposed on an upper base plate 92 of the centrifuge 90.

Referring to FIG. 1, a discharger 100 is affixed to a centrifuge 90 as part of the larger centrifuge assembly 1. The discharger 100 may be affixed to the upper base plate 92 of the centrifuge 90. The discharger 100 generally collects and removes select solid elements within the centrifuge 90. The centrifuge 90 may be any commercially available centrifuge able to receive the discharger 100. Such a centrifuge 90 is commercially available from Western States Machine Company, Fairfield, Ohio, and is sold under any one of the following brands: Roberts G-16 LINC, TITAN G-16 Batch, or G-8 Batch.

Figure 5:
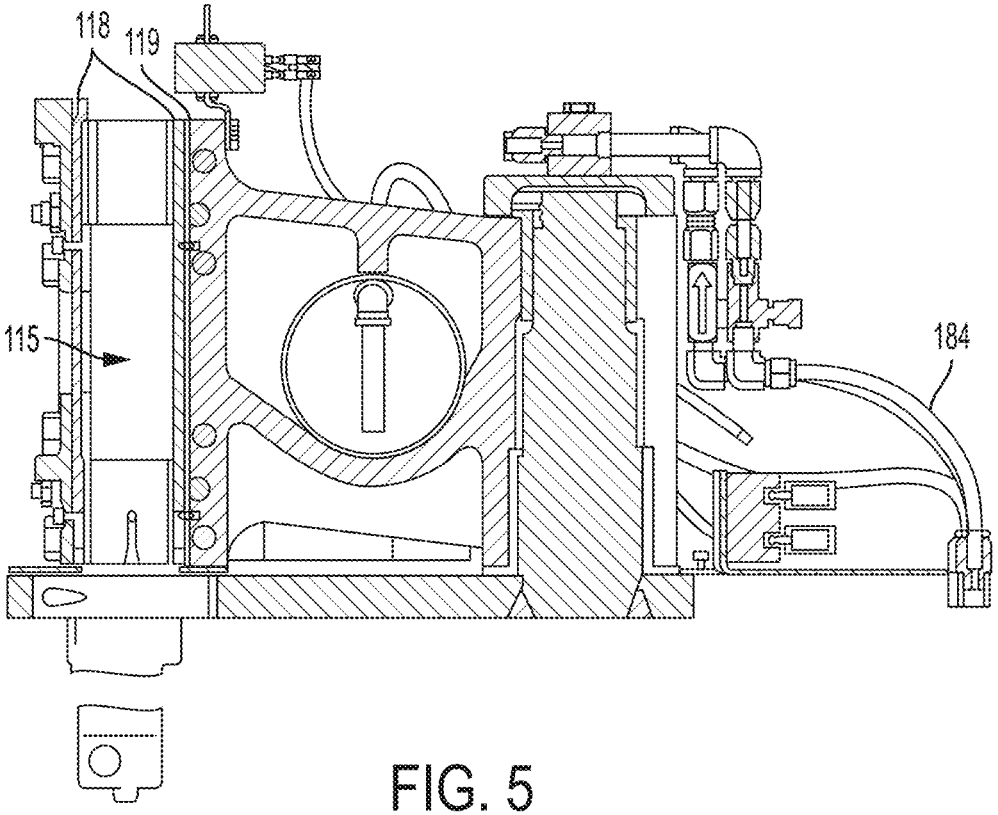
FIG. 5 depicts a side cross-sectional view of the discharger subassembly of FIG. 2 according to one or more embodiments shown and described herein.

As shown in FIGS. 2 and 5, the discharger 100 comprises a discharger subassembly 101, a driving air cylinder 102, an actuating air cylinder 129 a discharger shoe assembly 104, and a discharger ram 103. The actuating air cylinder 129 is generally used to actuate the discharger 100. The actuating air cylinder 129 pivots within the discharger subassembly 101 to drive the discharger shoe assembly 104 into the product. The driving air cylinder 102 drives the discharger ram 103 down, pushing the discharger shoe assembly 104 through the product. The discharger shoe assembly 104 is connected to the discharger subassembly 101 by the discharger ram 103. The discharger ram 103 is generally operable to position the discharger shoe assembly 104. The discharger shoe assembly 104 directs the select solid elements within and/or out of the centrifuge 90. It is contemplated that the discharger shoe assembly 104 may comprise a drive mechanism for driving the discharger shoe assembly 104.

As shown in FIGS. 3 and 5, other embodiments are contemplated. For example, the discharger ram 103 may only be partially surrounded by wear plates 118. The discharger ram 103 comprises an attachment end 134, wherein it attaches to the discharger shoe assembly 104, and an end 132 opposite the attachment end 134. As shown in FIG. 2, the discharger ram 103 may comprise a rectangular cross-section to be surrounded by four wear plates 118. Alternatively, the discharger ram 103 may have a polygonal cross-section with more or fewer sides, with a number of wear plates 118 equal to the number of sides.

As shown in FIGS. 3-5, the discharger subassembly 101 comprises a receptacle 115 configured to receive the discharger ram 103, wear plates 118, backing plates 119, and cam adjustment rods 112. The discharger ram 103 is inserted into the discharger subassembly 101 at receptacle 115 and surrounded by wear plates 118. Here, the gap 117 is the spacing between the wear plates 118 and backing plates 119, a spacing between the wear plates 118 and the discharger ram 103, or both. The backing plate 119 may be integral with the structure of the discharger subassembly 101, or a part of the larger whole. Alternatively, the backing plate 119 may be a separate object from the discharger subassembly 101, and secured thereto. The receptacle 115 may define an aperture large enough to receive the discharger ram 103 while being shaped in accordance with the discharger ram 103. Additionally, the receptacle 115 may define an aperture large enough fit wear plates 118 between the discharger ram 103 and the discharger subassembly 101 when the discharger ram 103 is inserted into the discharger subassembly 101. The discharger subassembly 101 may further comprise a series of tubing and connectors, through which fluids may move to facilitate operation of the discharger 100 and/or the centrifuge 90. Example tubing can be seen in FIG. 5 with tube 184. The presence of these elements when used with a discharger 100 improves the system as a whole. Without being limited by theory, the present invention eliminates the necessity of shims to adjust the amount of play in the discharger ram 103 by utilizing spacing mechanisms and movable wear plates 118.

Figure 4A:
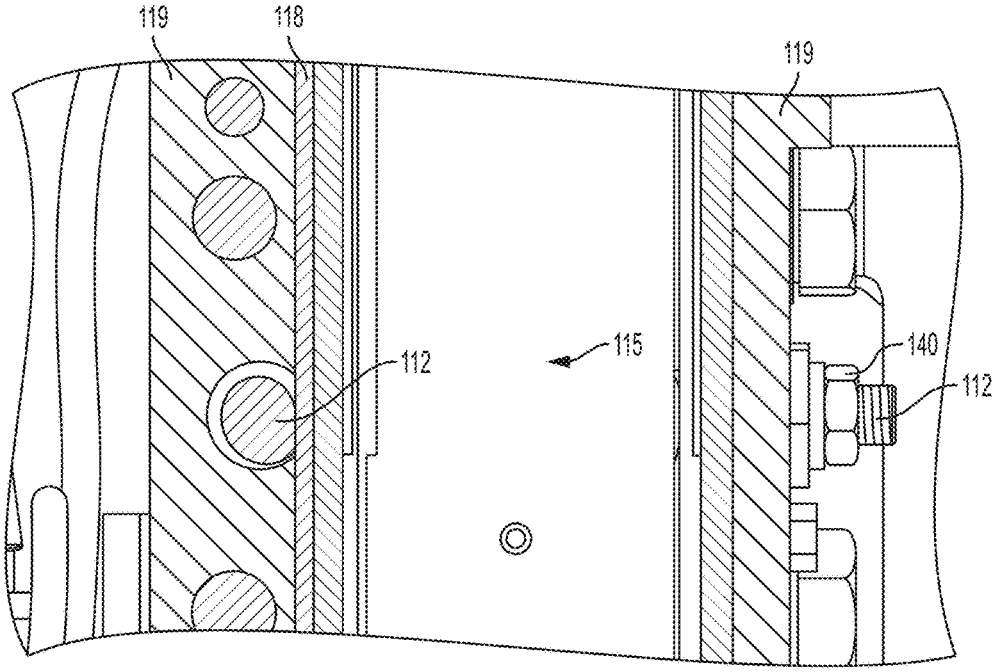
FIG. 4A depicts a side cross sectional view of the discharger of FIG. 2 at 0% adjustment according to one or more embodiments shown and described herein.
Figure 4B:
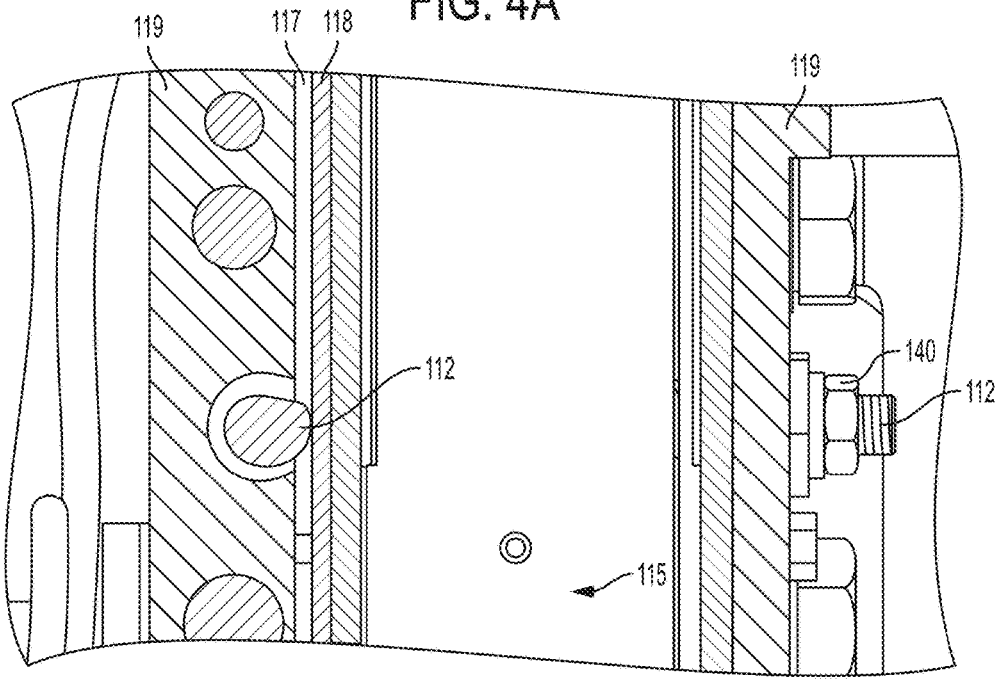
FIG. 4B depicts a side cross sectional view of the discharger of FIG. 2 at 100% adjustment according to one or more embodiments shown and described herein.

As shown in FIGS. 3-4B, the cam adjustment rods 112 may rotate to adjust the wear plates 118 in relation to the discharger ram 103 and the discharger subassembly 101. The cam adjustment rods 112 may extend through a portion of the discharger subassembly 101. Additionally or alternatively, the cam adjustment rods 112 may extend through the discharger subassembly 101. In the illustrated embodiment, the cam adjustment rods 112 rotate about an axis parallel to their respective wear plates 118 to produce linear movement by the respective wear plates 118. In a first configuration (See FIG. 4A), the cam adjustment rods 112 may be rotated so as to have the wear plates 118 flush with the backing plate 119. Alternatively, the cam adjustment rods 112 may be rotated to produce linear movement by the wear plates 118 and create a gap 117 between the wear plates 118 and the backing plate 119 (See FIG. 4B). In certain embodiments, the gap 117 between the wear plates 118 and the backing plate 119 may be approximately ⅛ inch. Alternatively, the gap 117 between the wear plates 118 and the backing plate 119 may be any value between about 0 and ⅛ inch. Additionally or alternatively, the discharger subassembly 101 may be configured to have a gap 117 larger than ⅛ inch. In rotating the cam adjustment rods 112 to produce linear movement by the wear plates 118, the wear plates 118 may be pressed more firmly against the sides of the discharger ram 103. In some embodiments, this linear movement of the wear plates 118 eliminates any gap 117 between the wear plates 118 and the sides of the discharger ram 103. Additionally, the discharger subassembly 101 may comprise jam nuts 140 or another suitable fastening member to further secure the cam adjustment rods 112 in a desired position. The jam nuts 140 secure the cam adjustment rods 112 to the to the discharger subassembly 101, which remains stable in relation to the actuating discharger ram 103.

Referring to FIGS. 4A and 4B, the discharger subassembly 101 comprises four cam adjustment rods 112, with each set of wear plates 118 configured to be moved linearly by a respective cam adjustment rod 112. Alternatively, the discharger subassembly 101 may comprise at least one wear plate 118 that is not configured to move linearly by a respective cam adjustment rod 112. This wear plate 118 may be static or configured to be adjusted in another manner. Additionally or alternatively, the discharger subassembly 101 may comprise more or fewer cam adjustment rods 112. Additionally or alternatively, the discharger subassembly 101 may comprise spacing mechanisms not equal to the number of sides of the discharge ram 103.

Figure 6:
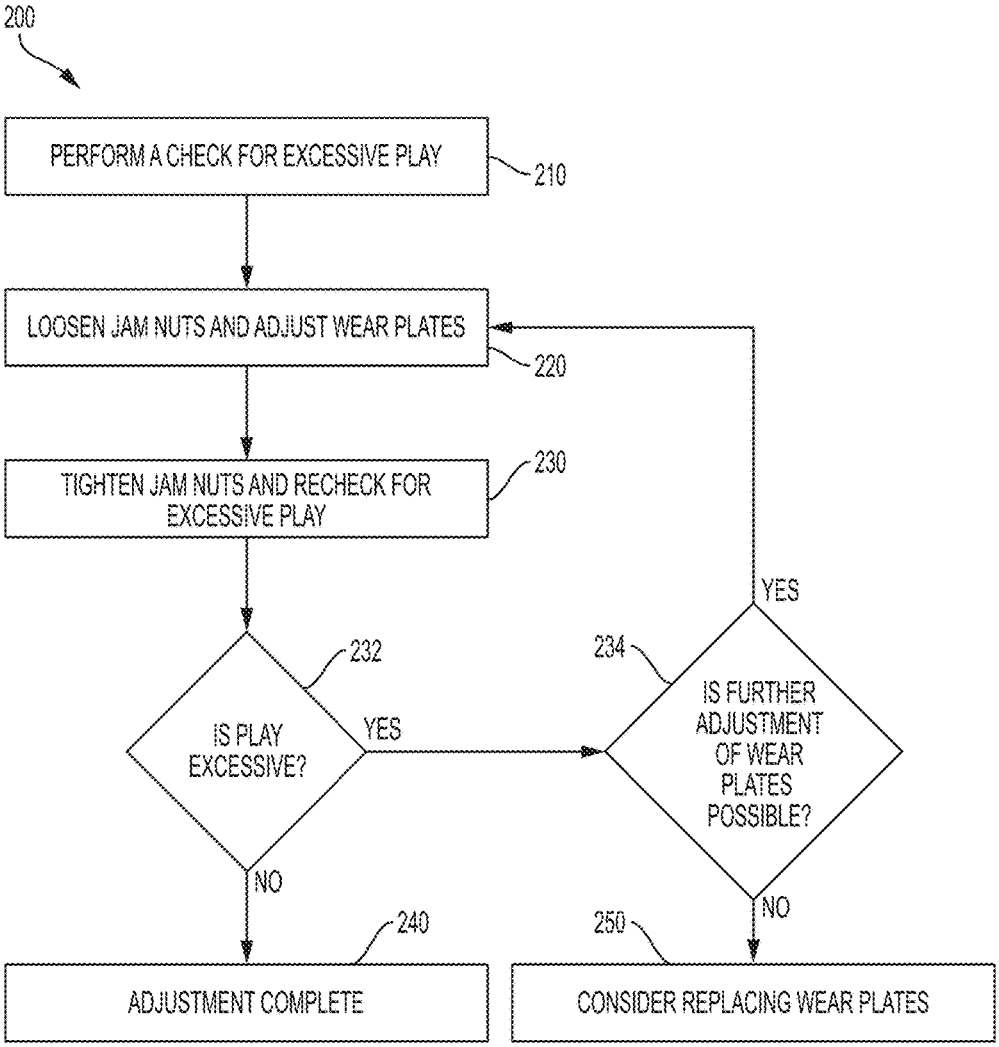
FIG. 6 depicts a flow chart of the method of adjusting the discharger according to one or more embodiments shown and described herein.

As shown in FIG. 6, the method 200 of adjusting the discharger 100 comprises the following steps. The first step 210 comprises an operator performing a check for excessive play at the top of the discharger ram 103 of the discharger subassembly 101 substantially as described above. During the first step 210, the amount of free play between the backing plate 119 and the wear plates 118 may be determined. The maximum amount of free play between the backing plate 119 and the wear plates 118 is measured at the top of the discharger ram 103 with the discharger 100 in the up and "on-rest" position. In one example, the maximum acceptable linear movement of the discharger ram 103 at the top 32 of the discharger ram 103 is approximately 1/16 inch. The linear movement of the discharger ram 103 may be measured by any electronic or manual method. The second step 220 comprises adjusting the wear plates 118 to remove excess free play. If the free play in the discharger ram 103 is determined to be excessive, the jam nuts 140 are loosened and the cam adjustment rods 112 are rotated. The cam adjustment rods 112 may be rotated with any standard tool, including, for example, a 3/16 inch Allen wrench. The third step 230 comprises tightening the jam nuts 140 over the cam adjustment rods 112 to the discharger subassembly 101 and rechecking the free play of the discharger ram 103. The fourth step 232 comprises determining whether the free play of the discharger ram 103 and the wear plates 118 is excessive. If the free play of the discharger ram 103 and the wear plates 118 is still excessive, the fifth step 234 requires determining if further adjustment of the wear plates 118 is possible. If further adjustment of the wear plates is possible, the cam adjustment rods 112 may be rotated again to move the wear plates 118 according to the second step 220. If it is not possible to sufficiently tighten the discharger ram 103 and the wear plates 118 within the discharger subassembly 101 by rotating the cam adjustment rods 112, the wear plates 118 may be replaced with other wear plates 118 as an optional step 250. If the free play of the discharger ram 103 is acceptable, the adjustment is complete according to the final step 240. During any and all of these steps, the discharger 100 may be in the "on-rest" position. Alternatively, the discharger 100 may be adjusted while in the "off" position.

It is also noted that recitations herein of "at least one" component, element, etc., should not be used to create an inference that the alternative use of the articles "a" or "an" should be limited to a single component, element, etc.

It is noted that recitations herein of a component of the present disclosure being "configured" to embody a particular property, or function in a particular manner, are structural recitations, as opposed to recitations of intended use. More specifically, the references herein to the manner in which a component is "configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

What is claimed is:

1. A discharger comprising a discharger subassembly comprising a plurality of wear plates, each wear plate having an internal surface and external surface;

a receptacle having lateral dimensions defined by the internal surfaces of the plurality of wear plates;

a plurality of backing plates laterally disposed around the external surfaces of the plurality of wear plates; and one or more spacing mechanisms extending through a portion of the discharger subassembly proximate the external surface of one or more of the wear plates;

a discharger ram insertable into the receptacle of the discharger subassembly, such that upon insertion, the wear plates are disposed between the discharge ram and the backing plates; and a discharger shoe assembly connected to the discharger subassembly by the discharger ram, the discharger ram being operable to position the discharger shoe assembly wherein actuation of one or more spacing mechanisms is operable to move one or more of the wear plates and thereby adjust a spacing between the wear plates and backing plates, a spacing between the wear plates and the discharger ram, or both.

2. The discharger of claim 1, wherein the discharger shoe assembly comprises a drive mechanism for driving the discharger shoe assembly.

3. The discharger of claim 2, wherein the drive mechanism is an air cylinder.

4. The discharger of claim 1, wherein the discharger ram is only partially surrounded by wear plates.

5. The discharger of claim 1, wherein the discharger subassembly further comprises a number of spacing mechanisms not equal to the number of sides of the discharge ram.

6. The discharger of claim 1, wherein the discharger ram further comprises a rectangular cross-section surrounded by four wear plates.

7. The discharger of claim 1, wherein the discharger ram further comprises a polygonal cross-section, with a number of wear plates equal to the number of sides.

8. The discharger of claim 1, wherein the spacing mechanisms are operable to rotate so as to have the wear plates flush with the backing plate.

9. The discharger of claim 1, wherein the spacing mechanisms are operable to rotate to produce linear movement by the wear plates and create the spacing between the wear plates and the backing plate.

10. The discharger of claim 1, wherein, the spacing mechanisms are operable to rotate about an axis parallel to their respective wear plates to produce linear movement by the respective wear plates.

11. The discharger of claim 1, wherein the discharger subassembly further comprises jam nuts operable to secure the spacing mechanisms to the discharger subassembly.

12. The discharger of claim 1, wherein the discharger subassembly further comprises at least one wear plate that is not configured to move linearly by a respective spacing mechanisms.

13. The discharger of claim 12, wherein the wear plate is static.

14. The discharger of claim 1, wherein one or more of the spacing mechanisms are cam adjustment rods.

15. A centrifuge comprising a discharger disposed on an upper base plate of the centrifuge, wherein the discharger comprises:

a discharger subassembly comprising a plurality of wear plates, each wear plate having an internal surface and external surface;

a receptacle having lateral dimensions defined by the internals surfaces of the plurality of wear plates;

a plurality of backing plates laterally disposed around the external surfaces of the plurality of wear plates; and one or more spacing mechanisms extending through a portion of the discharger subassembly proximate the external surface of one or more of the wear plates;

a discharger ram insertable into the receptacle of the discharger subassembly, such that, upon insertion, the wear plates are disposed between the discharge ram and the backing plates; and a discharger shoe assembly connected to the discharger subassembly by the discharger ram and disposed inside the centrifuge, the discharger ram being operable to position the discharger shoe assembly wherein actuation of one or more spacing mechanisms is operable to move one or more of the wear plates and thereby adjust a spacing between the wear plates and backing plates, a spacing between the wear plates and the discharger ram, or both.

16. The discharger of claim 15, wherein the spacing mechanisms are operable to rotate to produce linear movement by the wear plates and create the spacing between the wear plates and the backing plate.

17. The discharger of claim 15, wherein the discharger subassembly further comprises jam nuts operable to secure the spacing mechanisms to the discharger subassembly.

18. The discharger of claim 15, wherein the discharger subassembly further comprises at least one wear plate that is not configured to move linearly by a respective spacing mechanisms.

19. The discharger of claim 15, wherein one or more of the spacing mechanisms are cam adjustment rods.

20. The discharger of claim 1, wherein the discharger subassembly is free of shims.

* * * * *